US011141009B1

(12) United States Patent
Rane

(10) Patent No.: US 11,141,009 B1
(45) Date of Patent: Oct. 12, 2021

(54) ADJUSTABLE PILLOW CONTAINING SMALL PILLOWS

(71) Applicant: Peter Carlson Rane, St. George, UT (US)

(72) Inventor: Peter Carlson Rane, St. George, UT (US)

( * ) Notice: Subject to any disclaimer, the term of this patent is extended or adjusted under 35 U.S.C. 154(b) by 121 days.

(21) Appl. No.: 16/505,198

(22) Filed: Jul. 8, 2019

(51) Int. Cl.
*A47G 9/10* (2006.01)
*A47G 9/02* (2006.01)
*A47C 7/38* (2006.01)

(52) U.S. Cl.
CPC ..... *A47G 9/10* (2013.01); *A47C 7/383* (2013.01); *A47G 9/0253* (2013.01); *A47G 2009/1018* (2013.01)

(58) Field of Classification Search
CPC ..... A47G 9/10; A47G 2009/1018; A47G 9/0253; A47C 7/38; A47C 7/383
USPC ..... 5/640, 636, 639, 645, 490
See application file for complete search history.

(56) References Cited

U.S. PATENT DOCUMENTS 3,148,389 A 9/1964 Lustig
3,411,164 A 11/1968 Saul
4,754,513 A 7/1988 Rinz
4,949,411 A * 8/1990 Tesch ..... A47G 9/10 5/636
4,959,880 A 10/1990 Tesch
4,998,309 A * 3/1991 Tesch ..... A47G 9/10 5/636
5,016,303 A 5/1991 Tanaka
5,339,472 A * 8/1994 Yin ..... A47C 7/383 5/636
5,509,157 A * 4/1996 Story ..... A47G 9/0253 5/490
5,608,936 A * 3/1997 Nomura ..... B68G 1/00 5/645
5,682,633 A 11/1997 Davis
5,809,594 A 9/1998 Isogai
5,819,347 A 10/1998 Masuda
5,953,777 A 9/1999 Buck
6,151,733 A 11/2000 Takashima
6,363,557 B2 4/2002 Chou
6,367,105 B1 4/2002 Farley
6,652,034 B1 * 11/2003 Schramm ..... A47C 7/185 297/452.29
6,671,906 B1 1/2004 Milligan
(Continued)

FOREIGN PATENT DOCUMENTS

WO WO2010088779 A1 8/2010

*Primary Examiner* — Robert G Santos

(57) ABSTRACT

An adjustable pillow (1), which includes a casing (2) and a closable opening (12) to access the interior of the casing (2) where a plurality of small pillows (17) are contained. The small pillows (17) have filling (26) that provides support to the pillow (1) that is adjustable. The adjustment process involves a single variable of adjusting the quantity of small pillows (17) contained within the pillow (1) interior. This process allows incremental and simultaneous adjustments to the firmness, density, height and size of the pillow (1). Small pillows (17) are unique in shape, filling density and materials that allows them to self-adjust within the pillow (1) interior, creating a unified group of level filling (26) for the pillow. Small pillows (17) provide pleasing increments of adjustment that accommodates a wide range of sleeping positions and comfort preferences.

20 Claims, 5 Drawing Sheets

(56) References Cited

U.S. PATENT DOCUMENTS 6,910,237 B2 6/2005 DiGirolamo
7,089,617 B1 8/2006 Lauro
7,216,388 B2 * 5/2007 Bieganek ..... A61G 5/1043 5/653
7,222,379 B2 5/2007 DiGirolamo
7,322,057 B2 * 1/2008 Merlini ..... A47G 9/1045 5/484
7,530,127 B2 5/2009 Liefermann
7,788,750 B2 9/2010 Norstrem
8,347,435 B2 1/2013 Yu
8,656,537 B2 2/2014 Liefermann
8,707,485 B1 4/2014 Conley
8,893,331 B2 11/2014 Cupo
9,314,118 B2 4/2016 Blazar
9,462,902 B1 10/2016 Rukel
9,775,451 B1 10/2017 Chon
9,844,284 B1 12/2017 Chon
10,285,519 B1 * 5/2019 Muniz ..... A47C 23/007
2001/0003219 A1 * 6/2001 Chou ..... A47G 9/10 5/636
2004/0154101 A1 * 8/2004 DiGirolamo ..... A47G 9/0253 5/490
2005/0210590 A1 * 9/2005 DiGirolamo ..... A47G 9/10 5/636
2006/0112487 A1 * 6/2006 Taylor ..... A47G 9/0253 5/490
2006/0174411 A1 * 8/2006 Merlini ..... A47G 9/1045 5/490
2006/0248651 A1 * 11/2006 Lazakis ..... A47G 9/10 5/636
2013/0019409 A1 * 1/2013 Blazar ..... A47G 9/1027 5/644
2013/0263377 A1 10/2013 Wootten
2017/0042350 A1 2/2017 Mittal
2017/0143254 A1 5/2017 Bell
2018/0325291 A1 11/2018 Holbrook

* cited by examiner

ADJUSTABLE PILLOW CONTAINING SMALL PILLOWS

BACKGROUND—PRIOR ART

The following is a tabulation of some prior art that presently appears relevant:

| U.S. Pat. No. | Kind Code | Issue Date | Patentee |
|---|---|---|---|
| 3,148,389 | A | September 1964 | Lustig |
| 4,959,880 | A | October 1990 | Tesch |
| 5,953,777 | A | September 1999 | Buck |
| 7,222,379 | B2 | May 2007 | DiGirolamo |
| 9,314,118 | B2 | April 2016 | Blazar |
| 9,462,902 | B1 | October 2016 | Rukel |
| 9,775,451 | B1 | October 2017 | Chon |
| **U.S. Pub. No.** | **Kind Code** | **Publ. Date** | **Applicant** |
| 20170143254 | A1 | May 2017 | Bell |

BACKGROUND OF THE INVENTION

Conventional pillows are not adjustable and finding the right pillow may be difficult, where a person's sleeping position or comfort preferences may change. Additionally, pillow-filling materials may lose loft after extended use. Therefore conventional pillows often leave users in need of a new pillow.

Common pillow-filling materials include polyester fiber, microfiber, feathers, down or shredded foam. While these materials may provide comfortable support, they are extremely messy if direct access is permitted. An adjustable pillow must consider how to manage filling materials in addition to other variables that may affect the pillow's comfort and support, such as firmness, density, height, size and shape. Several adjustable pillows have been proposed, however, the solutions are often overwhelming and displeasing.

To adjust the support characteristics of a pillow kit, U.S. Pat. No. 7,222,379 to DiGirolamo describes core members that are inserted into or removed from individual chambers. However, loose filling accompanies core members within the chambers, consequently, the adjustment process is messy and displeasing.

An adjustable pillow shown in U.S. Pat. No. 5,953,777 to Buck describes individual layer inserts, which are stacked to adjust the pillow height within a stretchable pillowcase. However, the individual layer inserts are cumbersome as they are stacked then aligned across the full length and width of the pillow. In addition to stacking and aligning inserts, one must also choose from inserts with varying degrees of firmness. While these adjustment options may provide a wide variety of combinations, the process is overwhelming and excessive. U.S. Pat. No. 9,775,451 to Chon discloses a multi-position adjustable pillow with a convex-shaped top support piece to conform to a users head, neck and/or legs. Similar to Buck, a user must choose from a variety of support pieces having varying degrees of firmness and height, then stack and align the support pieces within the pillow interior. Similar to Buck, this process provides a wide variety of adjustment options, however, the process is again overwhelming and displeasing.

U.S. Pat. No. 9,314,118 to Blazar describes a customizable pillow with a self-inflating core that allows adjustments to be made without having to physically insert or remove any filling material. However, a pillow filled with air or other fluids is less desirable and does not match the quality of firmness and support provided by a pillow filled with common filling materials.

Therefore it would be desirable to have a pillow with a simple process of adjustment that considers a broad range of comfort and support variables. It would be desirable to have an adjustment process that keeps filling materials contained and provides a way to restore pillow filling after it has lost loft. New and unexpected discoveries have been made to accomplish this.

SUMMARY OF THE INVENTION

In accordance with one embodiment, an adjustable pillow which includes a casing and a closable opening to access the interior of the casing, where a plurality of small pillows are contained. The small pillows have filling that provides support to the pillow that is adjustable. The adjustment process involves a single variable of adjusting the quantity of small pillows contained within the pillow interior. This process allows incremental and simultaneous adjustments to the firmness, density, height and size of the pillow. Small pillows are unique in shape, filling density and materials that allows them to self-adjust within the pillow interior, creating a unified group of level filling for the pillow. The Small pillows provide pleasing increments of adjustment that accommodates a wide range of sleeping positions and comfort preferences. Additionally, small pillows that may have lost loft due to extended use may be replaced with new small pillows, to restore filling without having to replace the entire pillow.

Figure 1:
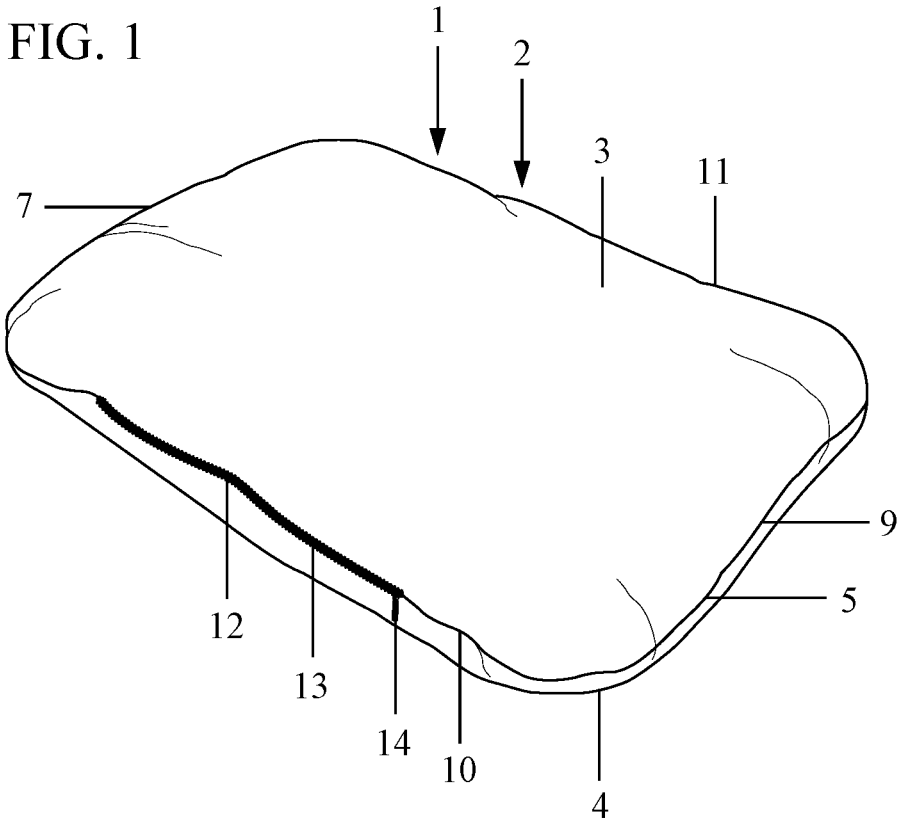
FIG. 1 shows a perspective view of an adjustable pillow in accordance with one embodiment.

| Drawings - Reference numerals | | | |
|---|---|---|---|
| 1 | pillow | 15 | top interior lining |
| 2 | casing | 16 | bottom interior lining |
| 3 | top | 17 | small pillows |
| 4 | bottom | 18 | rounded corners |
| 5 | seam | 19 | top filling |
| 7 | left seam | 20 | bottom filling |
| 9 | right seam | 21 | top surface |
| 10 | upper seam | 22 | bottom surface |
| 11 | lower seam | 23 | small pillow top surface |
| 12 | closable opening | 24 | small pillow bottom surface |

-continued

| Drawings - Reference numerals | | | |
|---|---|---|---|
| 13 | zipper | 25 | small pillow seam |
| 14 | zipper pull | 26 | small pillow filling |

DETAILED DESCRIPTION

An adjustable pillow 1 is disclosed with a casing 2 wherein a plurality of small pillows 17 is contained. To adjust the pillow 1, small pillows 17 may be inserted into or removed from the casing's 2 interior, through a closable opening 12. FIG. 1 to FIG. 9 illustrates one embodiment according to the present invention by way of example.

FIG. 1 illustrates a perspective view of the pillow 1. The casing 2 is comprised of a top 3 and a bottom 4. The top 3 and the bottom 4 may be any surface conducive to sleeping, for example pieces of fabric, a cooling gel surface, or a more complex structure of quilted fabric containing an interior layer of batting. Quilted fabric surfaces being best, as they have been found to provide a comfortable surface that works well in conjunction with the pillow 1 adjustment process. The casing 2 may be any shape conducive to sleeping, for example square shaped, rectangular shaped, round shaped, or any shape that provides comfortable support.

A seam 5 may connect the top 3 and the bottom 4 of the casing 2. The seam 5 may include a left seam 7, right seam 9, upper seam 10 and lower seam 11. Additional embodiments of the pillow 1 may include a gusset along the seam 5. The closable opening 12 allows access to the interior of the casing 2 and may be located anywhere along the seam 5 or anywhere on the exterior of the casing 2. The closable opening 12 may include a closure mechanism, for example a zipper 13. The closure mechanism as a zipper 13 may have a zipper pull 14 to open and close access to the interior of the casing 2. Additional embodiments of the pillow 1 may use a closure mechanism, such as buttons, snaps, resealable plastic zipper, hook-and-loop fastener, or anything that can allow an opening to be accessed when needed and closed when not needed.

Figure 2:
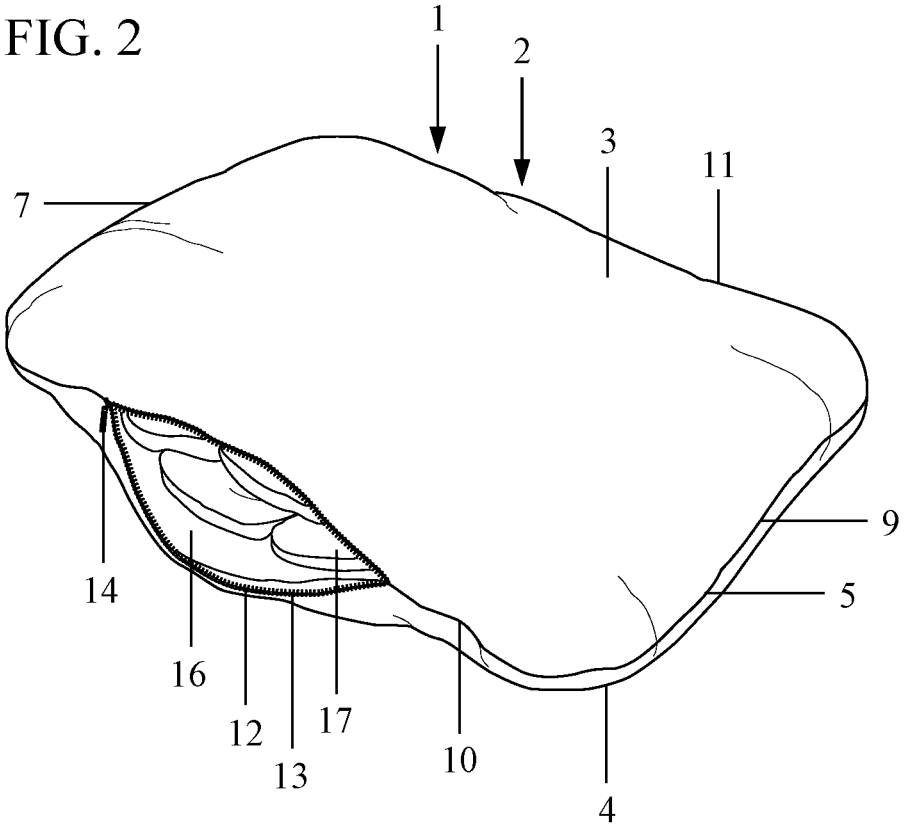
FIG. 2 shows a perspective view of the pillow with a closable opening open and a plurality of small pillows contained within the pillow interior.

FIG. 2 illustrates a perspective view of the pillow 1 with the closable opening 12 open and the plurality of small pillows 17 within the interior of the casing 2. Centering the closable opening 12 along the upper seam 10 has been found to be best, whereby the small pillows 17 may be evenly distributed throughout the interior of the casing 2, providing level support. The length of the closable opening 12 may range from 7 centimeters to the full length of the seam 5, 30 centimeters being best for allowing the small pillows 17 to be easily inserted into or removed from the interior of the casing 2.

Figure 3:
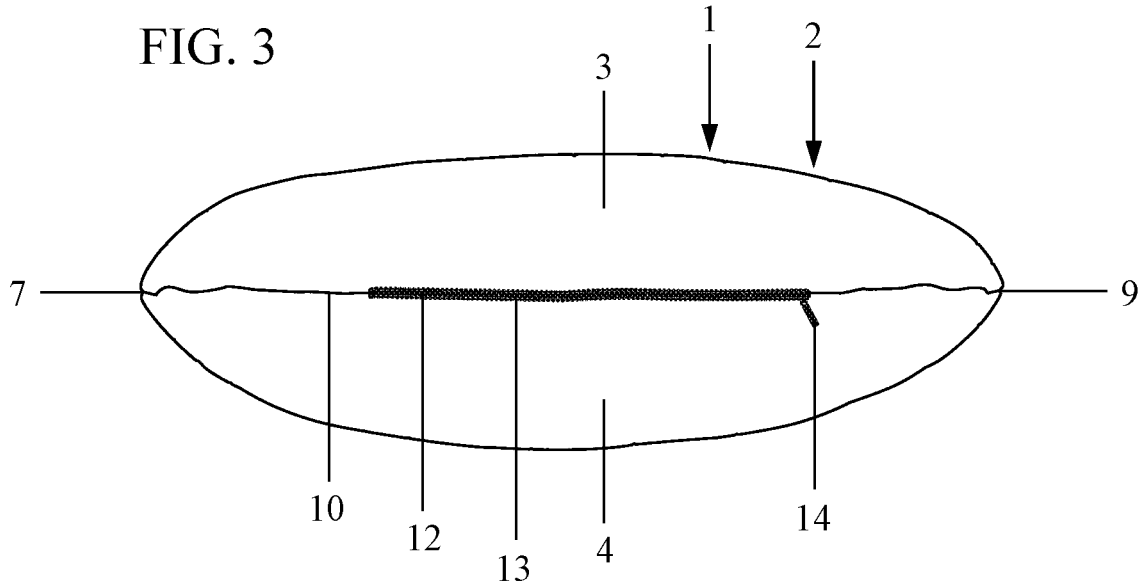
FIG. 3 shows a view of an upper seam of the pillow.
Figure 4:
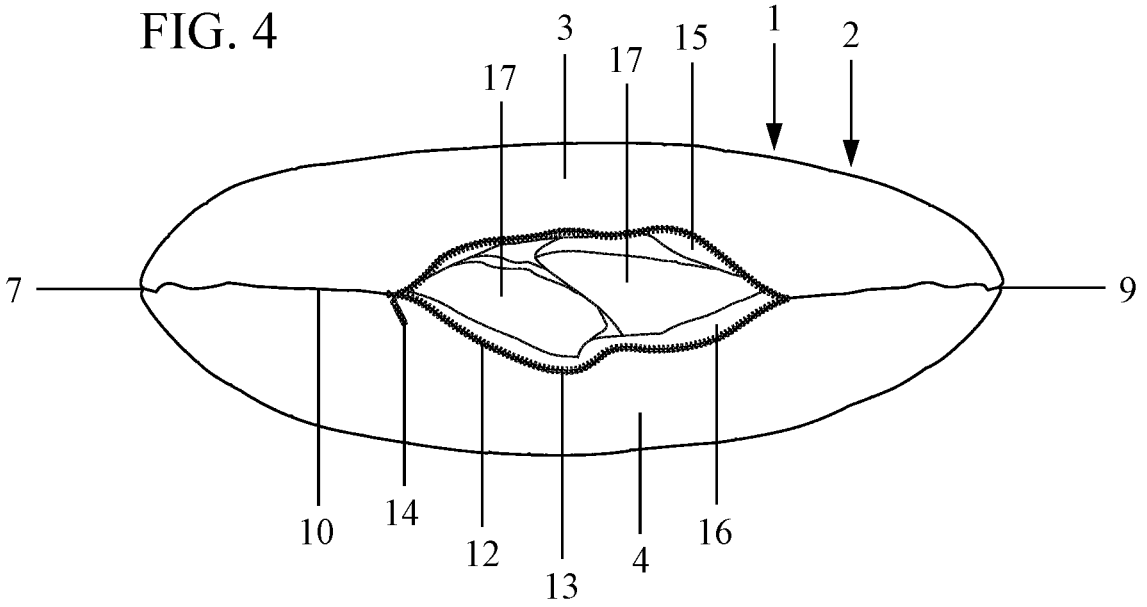
FIG. 4 shows a view of the upper seam of the pillow with the closable opening open and the plurality of small pillows contained within the pillow interior.

FIG. 3 illustrates a view of the upper seam 10 of the pillow 1 with the closable opening 12 closed. FIG. 4 illustrates a view of the upper seam 10 of the pillow 1 with the closable opening 12 open and the plurality of small pillows 17 within the pillow 1 interior.

Figure 5:
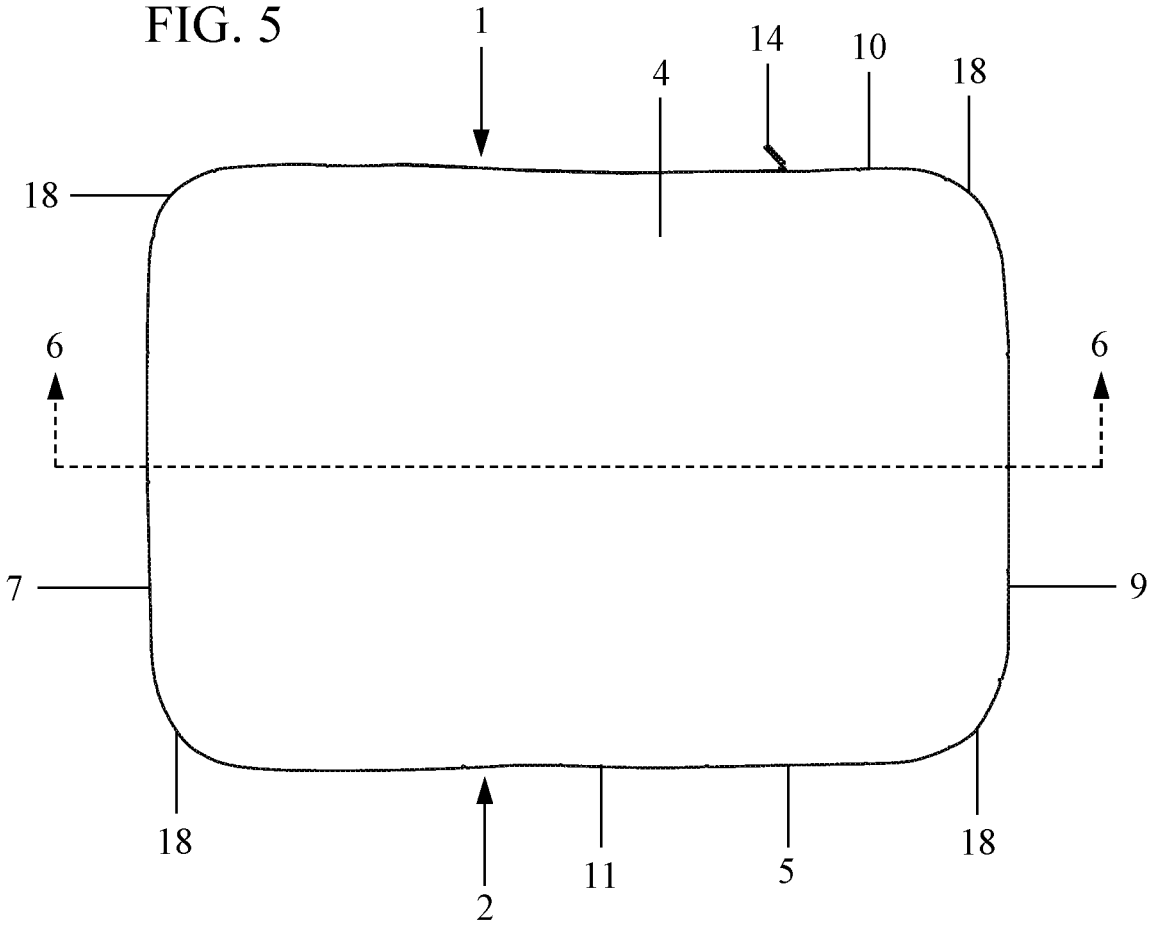
FIG. 5 shows a view of the bottom casing of the pillow.

FIG. 5 illustrates a view of the bottom 4 of the casing 2 and an example of the bottom 4 being rectangular shaped with optional rounded corners 18. Rounded corners 18 have been found to allow the small pillows 17 to more easily distribute to the full interior of the pillow 1, providing level support. While a person rests upon the pillow 1, rounded corners 18 have also been found to be a more pleasant interaction as opposed to a corner that comes to a point. Optional rounded corners 18 may be implemented in any embodiment of the pillow 1 where the casing 2 may come to a point. By way of example, radii for right-angled corners may be as large as 25 centimeters, 7 centimeters to 15 centimeters being best.

Figure 6:
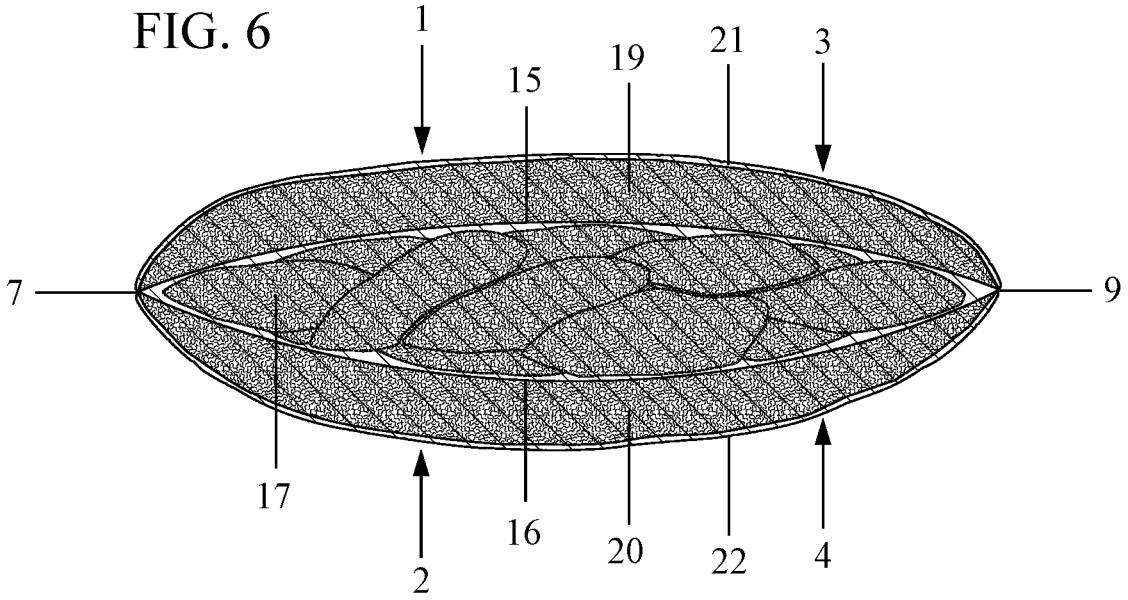
FIG. 6 shows a section view of the pillow from section lines 6-6 of FIG. 5.

FIG. 6 illustrates a section view of the pillow 1 taken from FIG. 5 along section lines 6-6. The top 3 is comprised of a top surface 21, a top filling 19, and a top interior lining 15. The bottom 4 is comprised of a bottom surface 22, a bottom filling 20, and a bottom interior lining 16. The top filling 19 and bottom filling 20 may be any filling material conducive to providing comfortable support, for example polyester fiber, microfiber, latex, feathers, down, cotton, wool, shredded foam, shredded memory foam, molded foam, microbeads, or combination thereof. Top interior lining 15, top filling 19, bottom interior lining 16, and bottom filling 20, have been found to provide added comfort to the pillow 1 in conjunction with the small pillows 17 and are good because no loose filling material is exposed. However, top interior lining 15, top filling 19, bottom interior lining 16, and bottom filing 20, are optional. FIG. 6 illustrates the plurality of small pillows 17 within the pillow 1 interior.

Figure 7:
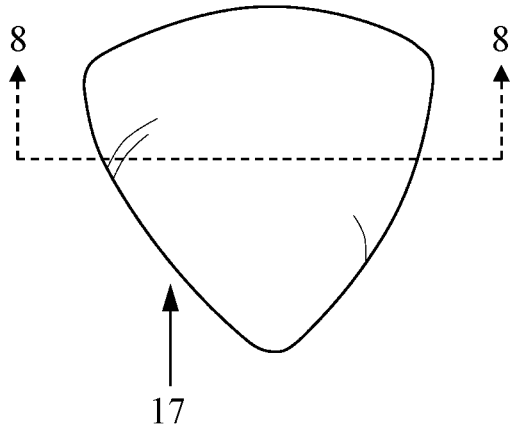
FIG. 7 shows a view of the top of one of the small pillows.

FIG. 7 illustrates a top view of a potential implementation of one of the individual small pillows 17. Small pillows 17 may be triangular shaped, square shaped, round shaped, star shaped, or any shape that may provide comfortable support for the pillow 1. It has been discovered that within the pillow 1 interior, small pillows 17 self-adjust along adjacent small pillows 17 due to their unique shape, size, materials and filling, thereby distributing throughout the pillow 1 interior. Triangular shaped small pillows 17 have been found to be best whereby spatial gaps between adjacent small pillows 17 are minimized as they self-adjust within the pillow 1 interior. The plurality of small pillows 17 with minimal spatial gaps provides a level support surface for the pillow 1. The triangular shape may be an equilateral triangle or close to an equilateral triangle.

A height to width ratio for small pillows 17 has been discovered that allows the plurality of small pillows 17 to lay flat that further helps create level support for the pillow 1 within the pillow 1 interior. The height to width ratio refers to the longest measurable height and the longest measurable width or length of the individual small pillows 17. The height to width ratio for the individual small pillows 17 may range from 1:1.25 to 1:10, with 1:1.5 to 1:4 being better, and 1:2.33 (i.e. 3:7) being best.

The size of the small pillows 17 is important in providing pleasing increments of adjustment to the pillow 1. The size refers to the longest measurable dimension across one of the individual small pillows 17. The size of the individual small pillows 17 may range from 3 centimeters to 50 centimeters across, with 10 centimeters to 25 centimeters being better, and 18 centimeters being best. The plurality of small pillows 17 may vary in size one from another. Small pillows 17 which are identical in size being best, whereby spatial gaps between adjacent small pillows 17 are minimized, and provide consistent increments of adjustment to the pillow 1.

Figure 8:
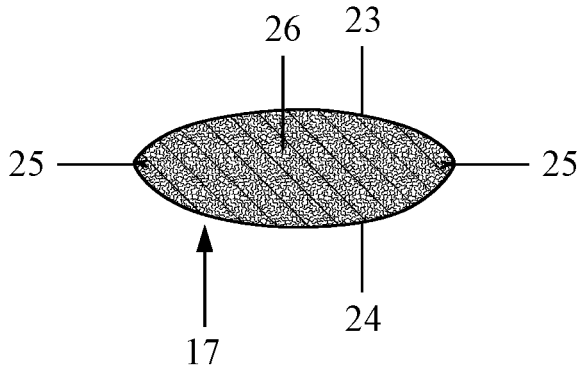
FIG. 8 shows a section view of the small pillow from section lines 8-8 of FIG. 7.

FIG. 8 illustrates a section view of one of the small pillows 17 taken from FIG. 7 along section lines 8-8. The individual small pillows 17 may be comprised of a top surface 23, a bottom surface 24 and a filling 26. A seam 25 may connect the top surface 23 and the bottom surface 24. The top surface 23 and the bottom surface 24 may be any fabric such as cotton, linen, polyester, silk, fleece, nylon, or any other material, including materials that may be the same as the filling 26 material. The best material for the top surface 23 and the bottom surface 24 has been found to be smooth cotton fabric, which allows the small pillows 17 to noiselessly shift along adjacent small pillows 17 as they self-adjust within the pillow 1 interior. Smooth cotton fabric is also good because it is breathable which allows the small pillows 17 to compress and conform as needed.

The filling 26 may be any material conducive to providing comfortable support, such as polyester fiber, microfiber, latex, feathers, down, cotton, wool, shredded foam, shredded memory foam, or micro-beads. The top surface 23 and the bottom surface 24 keeps loose filling 26 materials contained within the individual small pillows 17. The small pillows 17 may also be individually molded foam pieces, cut pieces of foam or other materials whereby the filling 26 may be the same material as the top surface 23 and the bottom surface 24. Filling 26 materials may lose loft over time with extended use, which may affect the comfort and height of the pillow 1. Small pillows 17 that have lost loft and height may be replaced with new or unused small pillows 17, thereby restoring the pillow 1 filling 26 without having to replace the entire pillow 1.

The firmness and density of the individual small pillows 17 are important factors that contribute to the comfort of the pillow 1. Firmness refers to how easily the small pillows 17 compress (i.e. how soft they are) and density measures the weight of the filling 26 per volume of the individual small pillows 17. Small pillows 17 having soft-firmness and low-density have been found to be best in providing a wide range of comfort adjustments and level support for the pillow 1. While the individual small pillows 17 may have a soft-firmness, adding small pillows 17 to the pillow 1 interior will incrementally increase the overall firmness of the pillow 1. Additionally, the increase in quantity of the small pillows 17 will provide a wide range of support for various sleeping positions by simultaneously increasing the height, size and overall density of the pillow 1. Decreasing the quantity of the small pillows 17 from the pillow 1 interior will provide the opposite effect that will incrementally provide a softer pillow 1 that is less dense, shorter in height and smaller in size. Low-density of the filling 26 also allows the combined filling 26 from the plurality of small pillows 17 to better unify within the pillow 1 interior, providing level pillow 1 support.

To measure firmness, an indentation test is followed where the small pillows 17 are tested individually as they lay flat on a level surface. A circular indenter 10 centimeters in diameter compresses one of the small pillows 17, 33 percent of its height. The weight required for 33 percent compression is recorded in grams and represents the firmness. A desired firmness for small pillows 17 may range from 75 grams to 300 grams, 130 grams being best.

The density of the filling 26 within the individual small pillows 17 is measured in grams per liter of volume and may range from 8.5 grams per liter to 35 grams per liter. The filling 26 materials may vary in density therefore the best density of the filling 26 by material is shown for example, polyester gel fiber equals 17 grams per liter, polyester cluster fiber equals 12.5 grams per liter, down equals 14 grams per liter, feathers equals 15.5 grams per liter, shredded foam equals 14.5 grams per liter, and shredded memory foam equals 20 grams per liter. The best density of the filling 26 for variations of the above materials or other materials, such as molded foam, may use a density found to work best that provides the desired firmness measurement of the small pillows 17.

Figure 9:
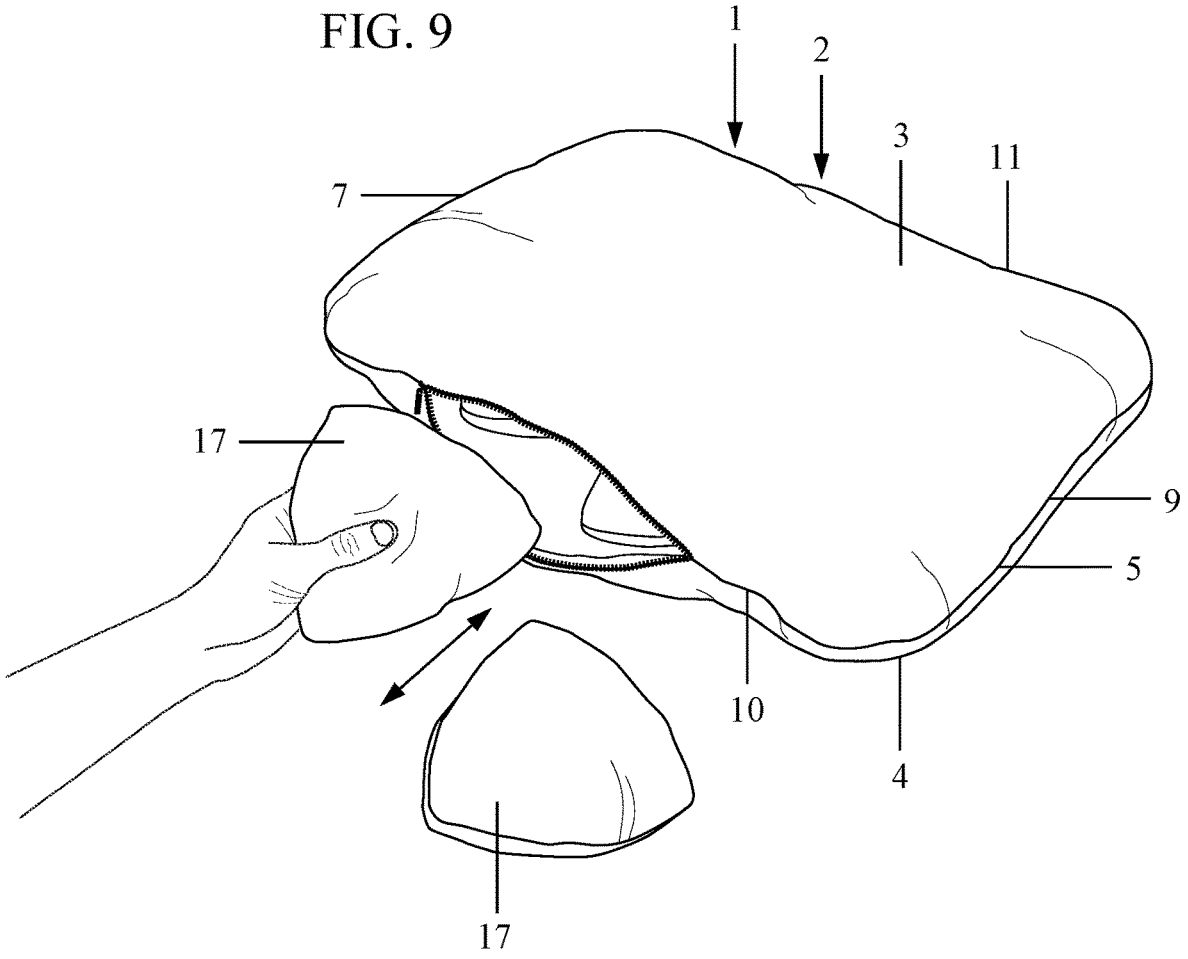
FIG. 9 shows a perspective view of the pillow with one of the small pillows being inserted into or removed from the pillow interior.

FIG. 9 illustrates a perspective view of the pillow 1 and the adjustment process. The adjustment process involves a single variable of adjusting the quantity of the small pillows 17 contained within the pillow 1 interior to achieve a desired firmness, density, height and size of the pillow 1.

What is claimed is:

1. An adjustable pillow comprising a casing with an enclosed interior, a closable opening to access the interior of the casing from the exterior, a plurality of small pillows with a filling density of less than 35 grams per liter of volume, where the small pillows are greater than 3 centimeters across, and where the small pillows are small enough to fit through the closable opening and fit in the interior of the casing and in the interior of the casing the plurality of small pillows substantially lay in the same horizontal plane.

2. The adjustable pillow of claim 1, where the plurality of small pillows is more than 3.

3. The adjustable pillow of claim 2, where the plurality of small pillows is more than seven.

4. The adjustable pillow of claim 1, where the casing is comprised of a top surface and a bottom surface connected by a seam.

5. The adjustable pillow of claim 4, where the casing includes atop interior lining attached along the interior perimeter of the top surface wherein a filling is enclosed and a bottom interior lining attached along the interior perimeter of the bottom surface wherein a filling is enclosed.

6. The adjustable pillow of claim 4, where the seam includes a gusset.

7. The adjustable pillow of claim 1, where the small pillow filling is fiber, microfiber, latex, feathers, down, cotton, wool, shredded foam, shredded memory foam, molded foam, micro-beads, or combination thereof.

8. The adjustable pillow of claim 1, where the small pillows are triangular shaped.

9. The adjustable pillow of claim 1, where the small pillows are comprised of a smooth fabric shell.

10. The adjustable pillow of claim 1, where the small pillows have a height to width ratio greater than 1 to 1.25.

11. The adjustable pillow of claim 10 where the small pillows have a height to width ratio less than 1:10.

12. The adjustable pillow of claim 1, where the small pillows are less than 25 centimeters across.

13. The adjustable pillow of claim 1, where the small pillows are comprised of a fabric that allows the small pillows to noiselessly shift in the interior of the casing.

14. An adjustable pillow comprising a casing comprised of a top surface and a bottom surface connected by a scam with an enclosed interior, a closable opening to access the interior of the casing from the exterior, a plurality of small pillows with a filling density of less than 35 grams per liter of volume, where the small pillows have a height to width ratio greater than 1 to 1.25, where the small pillows are greater than 3 centimeters across, where the small pillows are small enough to fit through the closable opening and fit in the interior of the casing, and where the plurality of small pillows is more than 3, and in the interior of the casing at least two of the plurality of small pillows are adjacent to each other in the same horizontal plane that is substantially parallel to the bottom surface.

15. The adjustable pillow of claim 14, where the casing includes a top interior lining attached along the interior perimeter of the top surface wherein a filling is enclosed and a bottom interior lining attached along the interior perimeter of the bottom surface wherein a filling is enclosed.

16. The adjustable pillow of claim 14, where the small pillows are comprised of a smooth fabric shell.

17. The adjustable pillow of claim 14, where the small pillows are triangular shaped.

18. A method for adjusting a pillow, comprising:

(a) providing an adjustable pillow comprising a casing comprised of a top surface and a bottom surface connected by a seam with an enclosed interior, a closable opening to access the interior of the casing from the exterior, a plurality of small pillows with a filling density of less than 35 grams per liter of volume, where the small pillows have a height to width ratio greater than 1 to 1.25, where the small pillows are greater than 3 centimeters across, where the small pillows are small enough to fit through the closable opening and fit in the interior of the casing, and where the plurality of small pillows is more than 3, and in the interior of the casing at least two of the plurality of small pillows substantially lay in the same horizontal plane that is substantially parallel to the bottom surface, (b) a desired quantity of the small pillows are added to the pillow interior through the closable opening for a firmer pillow with an increase in the pillow density, height and size, (c) a desired quantity of the small pillows are removed from the pillow interior through the closable opening for a softer pillow with a decrease in the pillow density, height and size, (d) the closable opening is closed, and the small pillows self-adjust within the pillow interior, whereby the pillow may be easily adjusted.

19. The method of adjusting a pillow of claim 18, where the pillow with small pillows is rested upon at intervals until the filling permanently loses loft and height, and by replacing the small pillows that have permanently lost loft and height with new small pillows thereby restoring the pillow.

20. The method of adjusting a pillow of claim 18, where the small pillows are triangular shaped.

* * * * *